US010049523B2

(12) United States Patent
You et al.

(10) Patent No.: US 10,049,523 B2
(45) Date of Patent: Aug. 14, 2018

(54) METHOD AND DEVICE FOR DETECTING OVERLAPPED BANK NOTES

(71) Applicant: GRG BANKING EQUIPMENT CO., LTD., Guangzhou, Guangdong (CN)

(72) Inventors: Jing You, Guangdong (CN); Qianwen Wang, Guangdong (CN); Jing Xu, Guangdong (CN)

(73) Assignee: GRG BANKING EQUIPMENT CO., LTD., Guangzhou, Guangdong (CN)

( * ) Notice: Subject to any disclaimer, the term of this patent is extended or adjusted under 35 U.S.C. 154(b) by 0 days.

(21) Appl. No.: 15/518,584

(22) PCT Filed: Aug. 7, 2015

(86) PCT No.: PCT/CN2015/086315

§ 371 (c)(1),
(2) Date: Apr. 12, 2017

(87) PCT Pub. No.: WO2016/065968

PCT Pub. Date: May 6, 2016

(65) Prior Publication Data

US 2017/0228956 A1 Aug. 10, 2017

(30) Foreign Application Priority Data

Oct. 30, 2014 (CN) ..... 2014 1 0605482

(51) Int. Cl.
*B65H 7/12* (2006.01)
*B65H 7/02* (2006.01)
(Continued)

(52) U.S. Cl.
CPC ..... *G07D 7/164* (2013.01); *B65H 7/02* (2013.01); *B65H 7/125* (2013.01); *G07D 7/183* (2017.05); *G07D 7/20* (2013.01); *B65H 2511/524* (2013.01)

(58) Field of Classification Search
CPC ..... G07D 7/164; G07D 7/20; G07D 7/183; B65H 7/02; B65H 7/125; B65H 2511/524
See application file for complete search history.

(56) References Cited

U.S. PATENT DOCUMENTS 6,796,434 B2 * 9/2004 Kako ..... B65H 7/02 209/534
7,052,008 B2 * 5/2006 Mitsuya ..... B65H 3/5261 271/122

(Continued)

FOREIGN PATENT DOCUMENTS

CN 1627327 A 6/2005
CN 102176262 A 9/2011

(Continued)

OTHER PUBLICATIONS

Extended European Search Report dated Oct. 17, 2017.
International Search Report for PCT/CN2015/086315, dated Oct. 28, 2015, ISA/CN.

*Primary Examiner* — Patrick Cicchino
(74) *Attorney, Agent, or Firm* — U.S. Fairsky LLP; Yue (Robert) Xu

(57) ABSTRACT

A method for detecting overlapped bank notes is provided. The method includes: step 10, collecting original image data of bank notes; step 20, performing security thread positioning detection on the original image data of the bank notes, to obtain security thread detection data; step 40, determining whether the security thread detection data meets a preset security thread reference condition, going to step 60 if the security thread detection data meets the preset security thread reference condition, and going to step 70 if the security thread detection data does not meet the preset security thread reference condition; step 60, obtaining a determination result that the bank notes are not overlapped, and ending the method; and step 70, obtaining a determining (Continued)

result that the bank notes are overlapped, and ending the method.

4 Claims, 9 Drawing Sheets

(51) Int. Cl.

| | |
|---|---|
| ***G07D 7/16*** | (2016.01) |
| ***G07D 7/20*** | (2016.01) |
| ***G07D 7/183*** | (2016.01) |
| ***G07D 7/164*** | (2016.01) |

(56) References Cited

U.S. PATENT DOCUMENTS

| | | | | |
|---|---|---|---|---|
| 7,619,721 | B2 * | 11/2009 | Jones | G06Q 20/18 356/71 |
| 8,651,481 | B2 * | 2/2014 | Woodford | G07D 7/164 271/262 |
| 9,014,458 | B2 * | 4/2015 | Liang | G07D 7/04 382/135 |
| 2001/0035329 | A1 | 11/2001 | Toda | |
| 2005/0087422 | A1 * | 4/2005 | Maier | G07D 7/164 194/207 |
| 2005/0141759 | A1 | 6/2005 | Mori | |
| 2012/0256371 | A1 * | 10/2012 | Woodford | G01B 7/06 271/265.02 |
| 2013/0075970 | A1 | 3/2013 | Kozlowski | |
| 2015/0042353 | A1 | 2/2015 | Jang | |

FOREIGN PATENT DOCUMENTS

| | | | | |
|---|---|---|---|---|
| CN | 102456246 | A | 5/2012 | |
| CN | 102556708 | A | 7/2012 | |
| CN | 203 882 369 | U | 10/2014 | |
| CN | 104268979 | A | 1/2015 | |
| EP | 0 429 184 | A1 | 5/1991 | |
| EP | 0430810 | A1 | 6/1991 | |
| EP | 2 631 881 | A1 | 8/2013 | |
| EP | 2631881 | A1 * | 8/2013 | G07D 7/04 |
| EP | 2631881 | A1 | 8/2013 | |
| JP | 2002 230619 | A | 8/2002 | |
| JP | 2008063685 | A | 3/2008 | |

* cited by examiner

METHOD AND DEVICE FOR DETECTING OVERLAPPED BANK NOTES

This application is the national phase of International Application No. PCT/CN2015/086315, titled "METHOD AND DEVICE FOR DETECTING OVERLAPPED BANK NOTES" filed on Aug. 7, 2015, which claims the priority to Chinese Patent Application No. 201410605482.3, titled "METHOD AND DEVICE FOR DETECTING OVERLAPPED BANK NOTES" and filed with the Chinese State Intellectual Property Office on Oct. 30, 2014, both of which are incorporated herein by reference in their entireties.

FIELD

The present disclosure relates to technology of bank note recognition, and particularly to a method and a device for detecting overlapped bank notes.

BACKGROUND

Bank notes are received or outputted continually in a cash transaction device, especially in an Automatic Teller Machine (ATM) which has been one of important means for people to obtain cash, and thus recognition and detection on the bank notes is required. Due to an influence of external environment and different properties of the bank notes, the bank notes may be overlapped to each other, that is, overlapped bank notes occur. If it can not be detected accurately whether the bank notes are overlapped, an account dispute may be caused, which results in a serious result.

A most common method for detecting overlapped bank notes is to detect the overlapped bank notes based on the thickness of a bank note. For example, an ultrasonic sensor or a thickness sensor is used to detect the thickness of a bank note. However, information on the thickness of a bank note is very rich due to diversity of information on the surface of the bank note. In this case, detection by the thickness sensor will result in an error or misjudgment on the overlapped bank notes. For example, since the thickness of a security thread area of a bank note is far greater than the average thickness of the other areas of the bank note in most countries, the following problem occurs if the thickness sensor is used to detect whether the bank notes are overlapped. If the non-security thread area passes through the thickness sensor, whether bank notes are overlapped can be detected accurately without misjudgment. If the security thread area passes through the thickness sensor, the thickness sensor detects an exceeding thickness, and thus misjudges the overlapped bank notes, which results in rejection of a large number of bank notes and unstable receiving rate of the bank notes, thus causing a very poor user experience. In this case, although the problem described above can be solved by a method of increasing a thickness reference value or a method of extending a dynamic scope, these methods may bring a new risk that the actual overlapped bank notes cannot be detected, which is very serious.

SUMMARY

In order to solve a technical problem in the conventional technology that the thickness sensor tends to misjudge when detecting overlapped bank notes due to the fact that the thickness of a security thread area of a bank note is far greater than an average thickness of a non-security thread area of the bank note, a method for detecting overlapped bank notes is provided according to the present disclosure, in which, the thickness of the security thread area and the thickness of the non-safety-line area are distinguished and detected respectively, to prevent a financial self-service equipment from misjudging the overlapped bank notes.

A device for detecting overlapped bank notes is further provided according to the present disclosure.

A method for detecting overlapped bank notes is provided according to the present disclosure, the method includes: step 10, collecting original image data of bank notes; step 20, performing security thread positioning detection on the original image data of the bank notes, to obtain security thread detection data; step 40, determining whether the security thread detection data meets a preset security thread reference condition, going to step 60 if the security thread detection data meets the preset security thread reference condition, and going to step 70 if the security thread detection data does not meet the preset security thread reference condition; step 60, obtaining a determination result that the bank notes are not overlapped, and ending the method; and step 70, obtaining a determining result that the bank notes are overlapped, and ending the method.

Specifically, in the step 20, the security thread detection data includes: a physical distance (X1, Y1) from an upper left vertex of a position of a security thread to a calibration side of a scanner, a physical distance (Xr, Yr) from a lower right vertex of the position of the security thread to the calibration side of the scanner, and an absolute position of the security thread to the calibration side determined based on the physical distance (X1, Y1) and the physical distance (Xr, Yr).

Preferably, the step 40 further includes: step 41, determining whether a width of the security thread meets the security thread reference condition, going to step 42 if the width of the security thread meets the security thread reference condition, and going to step 44 if the width of the security thread does not meet the security thread reference condition; step 42, determining whether a thickness of the security thread area meets the security thread reference condition, going to step 43 if the thickness of the security thread area meets the security thread reference condition, and going to step 44 if the thickness of the security thread area does not meet the security thread reference condition; step 43, determining that the bank notes are not overlapped in the security thread area, and going to step 50; and step 44, determining that the bank notes are overlapped in the security thread area, and going to step 70.

Specifically, in the step 41 of determining whether the width of the security thread meets the security thread reference condition, (X1, Y1) represents a position of an upper left vertex of a security thread of a single sheet of bank note to the calibration side, (Xr, Yr) represents a position of a lower right vertex of a security thread of a single sheet of bank note to the calibration side, (Xx, Yy) represents a position of an upper left vertex of a security thread of detected overlapped bank notes to the calibration side, (XX, YY) represents a position of a lower right vertex of a security thread of detected overlapped bank notes to the calibration side and T represents a preset non-negative threshold parameter; it is determined that the width of the security thread does not meet the security thread reference condition and that the width of the security thread is abnormal if the width of the security thread area meets $|(XX,YY)-(Xx,Yy)|>|(Xr,Yr)-(X1,Y1)|+T$, and it is determined that the width of the security thread meets the security thread reference condition and that the width of the security thread is normal if the width of the security thread does not meet $|(XX,YY)-(Xx,Yy)|>|(Xr,Yr)-(X1,Y1)|+T$.

Specifically, in the step 42 of determining whether the thickness of the security thread area meets the security thread reference condition, a represents the thickness of a security thread area obtained by a current thickness sensor, b represents a reference value of the thickness of the security thread area, and t represents a preset non-negative threshold parameter; and it is determined that the thickness of the security thread area does not meet the security thread reference condition and that the thickness of the security thread area is abnormal if the thickness of the security thread area meets a>b*t, and it is determined that the thickness of the security thread area meets the security thread reference condition and that the thickness of the security thread area is normal if the thickness of the security thread area does not meet a>b*t.

A method for detecting overlapped bank notes is further provided according to the present disclosure, the method includes: step 10, collecting original image data of bank notes; step 30, performing non-security thread positioning detection on the original image data of the bank notes, to obtain non-security thread area detection data; step 50, determining whether the non-security thread area detection data meets a preset non-security thread reference condition, going to step 60 if the non-security thread area detection data meets the preset non-security thread reference condition, and going to step 70 if the non-security thread area detection data does not meet the preset non-security thread reference condition; step 60, obtaining a determination result that the bank notes are not overlapped, and ending the method; and step 70, obtaining a determining result that the bank notes are overlapped, and ending the method.

Preferably, step 50 further includes: step 51, determining whether the thickness of the non-security thread area meets the non-security thread reference condition, going to step 52 if the thickness of the non-security thread area meets the non-security thread reference condition, and going to step 54 if the thickness of the non-security thread area does not meet the non-security thread reference condition; step 52, determining whether a difference between the thickness of the non-security thread area and an average thickness of bank notes meets the non-security thread reference condition, going to step 53 if the difference between the thickness of the non-security thread area and an average thickness of bank notes meets the non-security thread reference condition, going to step 54 if the difference between the thickness of the non-security thread area and an average thickness of bank notes does not meet the non-security thread reference condition; step 53, determining that the bank notes are not overlapped in the non-security thread area, and going to step 60; and step 54, determining that the bank notes are overlapped in the non-security thread area, and going to step 70.

Specifically, in the step 51 of determining whether the thickness of the non-security thread area meets the non-security thread reference condition, c represents the thickness of the non-security thread area obtained by a current thickness sensor, d represents a reference value of the thickness of the non-security thread area, and s represents a preset non-negative threshold parameter, it is determined that the thickness of the non-security thread area does not meet the non-security thread reference condition and that the thickness of the non-security thread area is abnormal if the thickness of the non-security thread area meets c>d*s; and it is determined that the thickness of the non-security thread area meets the non-security thread reference condition and that the thickness of the non-security thread area is normal if the thickness of the non-security thread area does not meet c>d*s.

Specifically, in the step 52 of determining whether the difference between the thickness of the non-security thread area and the average thickness of bank notes meets the non-security thread reference condition, e represents the thickness of the non-security thread area obtained by a current thickness sensor, v represents an average thickness reference value of bank notes obtained through statistics, and f represents a preset non-negative threshold parameter; and it is determined that the difference between the thickness of the non-security thread area and the average thickness of bank notes does not meet the non-security thread reference condition and that the thickness of the non-security thread area is abnormal if the difference between the thickness of the non-security thread area and the average thickness of bank notes meets e−v>f, and it is determined that the difference between the thickness of the non-security thread area and the average thickness of bank notes meets the non-security thread reference condition and that the thickness of the non-security thread area is normal if the difference between the thickness of the non-security thread area and the average thickness of bank notes does not meet e−v>f. A method for detecting overlapped bank notes is further provided according to the present disclosure, the method includes: step 10, collecting original image data of bank notes; step 20, performing security thread positioning detection on the original image data of the bank notes, to obtain security thread detection data; step 30, performing non-security thread positioning detection on the original image data of the bank notes, to obtain non-security thread area detection data; step 40, determining whether the security thread detection data meets a preset security thread reference condition, going to step 50 if the security thread detection data meets the preset security thread reference condition, and going to step 70 if the security thread detection data does not meet the preset security thread reference condition; step 50, determining whether the non-security thread area detection data meets a preset non-security thread reference condition, going to step 60 if the non-security thread area detection data meets the preset non-security thread reference condition, and going to step 70 if the non-security thread area detection data does not meet the preset non-security thread reference condition; step 60, obtaining a determination result that the bank notes are not overlapped, and ending the method; and step 70, obtaining a determining result that the bank notes are overlapped, and ending the method.

A device for detecting overlapped bank notes is provided according to the present disclosure, the device includes: a data collecting module configured to collect original image data of bank notes to be detected; a security thread positioning detection module connected with the data collecting module and configured to perform security thread positioning detection on the collected original image data of the bank notes, to obtain security thread detection data; a non-security thread positioning detection module connected with the data collecting module and configured to perform non-security thread positioning detection on the collected original image data of the bank notes, to obtain non-security thread detection data; a security thread area overlapped bank notes detection module connected with the security thread positioning detection module and configured to determine whether a security thread area meets a security thread reference condition based on the security thread detection data, and determine that the bank notes are overlapped in the security thread area if the security thread detection data does not meet the security thread reference condition, and determine that the bank notes are not overlapped in the security thread area if the security thread detection data meets the security thread reference condition; a non-security thread area overlapped bank notes detection module connected with the non-security thread positioning detection module and configured to determine whether a non-security thread area meets a non-security thread reference condition based on the non-security thread detection data, determine that the bank notes are overlapped in the non-security thread area if the non-security thread data does not meet the non-security thread reference condition, and determine that the bank notes are not overlapped in the non-security thread area if the non-security thread data meets the non-security thread reference condition; and an overlapped bank notes detection module connected with the security thread area overlapped bank notes detection module and the non-security thread area overlapped bank notes detection module and configured to detect whether the bank notes are overlapped based on local overlapped bank notes determination results for the security thread area and the non-security thread area and following a preset determination rule.

Preferably, the preset determination rule includes: determining that the bank notes are overlapped if the bank notes are overlapped in the non-security thread area; and determining whether the bank notes are overlapped depending on the overlapped bank notes determination results for the security thread area if the bank notes are not overlapped in the non-security thread area as: determining that the bank notes are overlapped if the bank notes are overlapped in the security thread area, and determining that the bank notes are not overlapped if the bank notes are not overlapped in the security thread area.

A device for detecting overlapped bank notes is provided according to the present disclosure, the device includes: a data collecting module configured to collect original image data of bank notes to be detected; a security thread positioning detection module connected with the data collecting module and configured to perform security thread positioning detection on the collected original image data of the bank notes, to obtain security thread detection data; a security thread area overlapped bank notes detection module connected with the security thread positioning detection module and configured to determine whether a security thread area meets a security thread reference condition based on the security thread detection data, and determine that the bank notes are overlapped in the security thread area if the security thread detection data does not meet the security thread reference condition, and determine that the bank notes are not overlapped in the security thread area if the security thread detection data meets the security thread reference condition; and an overlapped bank notes detection module connected with the security thread area overlapped bank notes detection module and configured to detect whether the bank notes are overlapped based on a local overlapped bank notes determination result for the security thread area and following a determination rule, where the determination rule includes: determining that the bank notes are overlapped if the bank notes are overlapped in the security thread area; and determining that the bank notes are not overlapped if the bank notes are not overlapped in the security thread area.

A device for detecting overlapped bank notes is provided according to the present disclosure, the device includes: a data collecting module configured to collect original image data of bank notes to be detected; a non-security thread positioning detection module connected with the data collecting module and configured to perform non-security thread positioning detection on the collected original image data of the bank notes, to obtain non-security thread detection data; a non-security thread area overlapped bank notes detection module connected with the non-security thread positioning detection module and configured to determine whether a non-security thread area meets a non-security thread reference condition based on the non-security thread detection data, determine that the bank notes are overlapped in the non-security thread area if the non-security thread data does not meet the non-security thread reference condition, and determine that the bank notes are not overlapped in the non-security thread area if the non-security thread data meets non-security thread reference condition; and an overlapped bank notes detection module connected with the non-security thread area overlapped bank notes detection module and configured to detect whether the bank notes are overlapped based on a local overlapped bank notes determination result for the non-security thread area and following a preset determination rule, where the determination rule includes: determining that the bank notes are overlapped if the bank notes are overlapped in the non-security thread area; and determining that the bank notes are not overlapped if the bank notes are not overlapped in the non-security thread area.

Three methods for detecting overlapped bank notes are provided in the present disclosure, the original image data of the bank notes to be detected are collected first, the security thread positioning detection and/or the non-security thread positioning detection are performed on the original image data, whether the bank notes are overlapped can be determined directly based on the obtained local overlapped bank notes determination result for the security thread area or the non-security thread area. Alternatively, whether the bank notes are overlapped can be detected by combining the obtained local overlapped bank notes determination results for the security thread area and the non-security thread area and following the determination rule. Since the thickness of a security thread area of a bank note is far greater than the thickness of the other areas of the bank note in most countries, the thickness of the security thread area and the thickness of the non-security thread areas of a bank note are distinguished and overlapped bank notes are judged through by detecting and positioning the security thread of the bank notes, thereby avoiding the problem of misjudgment on overlapped bank notes caused by an exceeding thickness of the security thread. Therefore, not only the overlapped bank notes can be detected accurately, but also the receiving rate of the bank notes can be improved greatly.

BRIEF DESCRIPTION OF THE DRAWINGS

In order to more clearly illustrate the technical solution in the embodiments of the present disclosure or in the conventional technology, in the following, drawings required in the description of the embodiments or the conventional technology will be introduced simply. Obviously, the drawings in the following description show only some embodiments of the disclosure. For those skilled in the art, other drawings can also be obtained according to the drawings without any creative work.

DETAILED DESCRIPTION

In order to further describe the method and the device for detecting overlapped bank notes provided in the present disclosure, the method and the device for detecting overlapped bank notes are illustrated in detail below in conjunction with the drawings.

A concept of a security thread is explained first. The security thread is a common characteristic of all bank notes. Each bank note is inlaid with a metal line, which has the same width as the bank note. The metal line is referred to as the security thread, which is divided into a type of solid line and a type of dotted line. The metal line is also referred to as a windowed security thread and is an important anti-fake characteristic. The thickness of the security thread is different from the thickness of the other area of the bank note, and normally is far greater than the thickness of other area of the bank note.

Figure 1:
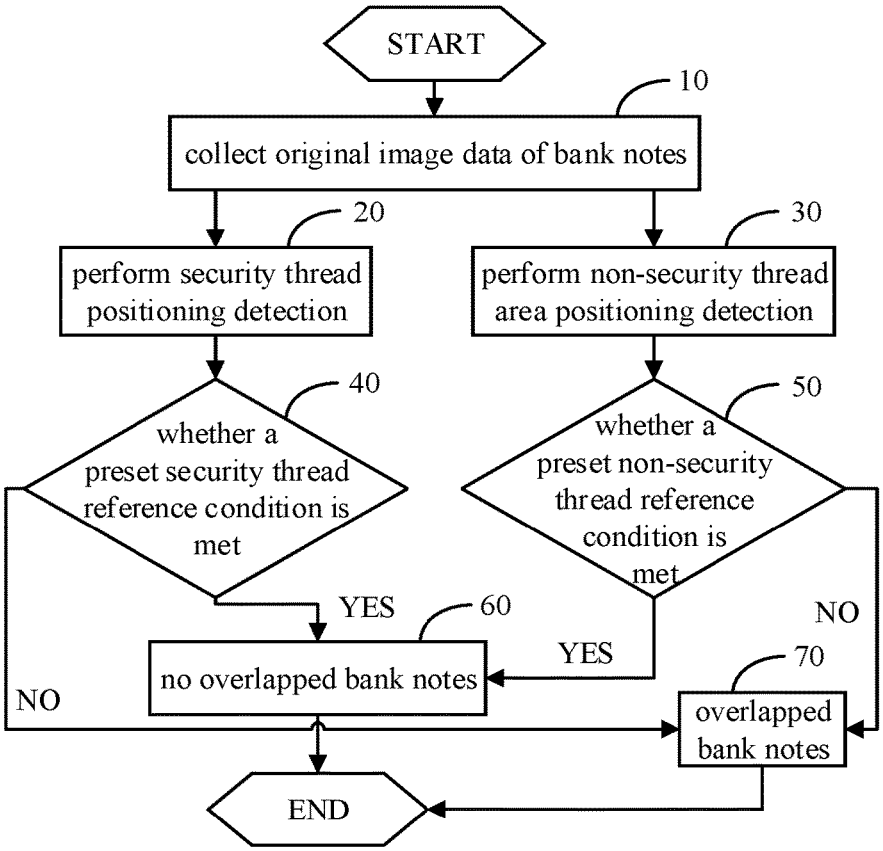
FIG. 1 is a flowchart of a method for detecting overlapped bank notes according to a first embodiment of the present disclosure.

As shown in FIG. 1, a method for detecting overlapped bank notes according to a first embodiment of the present disclosure includes: step 10, collecting original image data of bank notes; step 20, performing security thread positioning detection on the original image data of the bank notes, to obtain security thread detection data; step 30, performing non-security thread positioning detection on the original image data of the bank notes, to obtain non-security thread area detection data; step 40, determining whether the security thread detection data meets a preset security thread reference condition, going to step 50 if the security thread detection data meets the preset security thread reference condition, and going to step 70 if the security thread detection data does not meet the preset security thread reference condition; step 50, determining whether the non-security thread area detection data meets a preset non-security thread reference condition, going to step 60 if the non-security thread area detection data meets the preset non-security thread reference condition, and going to step 70 if the non-security thread area detection data does not meet the preset non-security thread reference condition; step 60, obtaining a determination result that the bank notes are not overlapped, and ending the method; and step 70, obtaining a determining result that the bank notes are overlapped, and ending the method.

In the method, whether the bank notes are overlapped is detected based on a multi-point thickness sensor, each step of which is described below.

In step 10 of collecting the original image data of the bank notes, bank notes to be detected are scanned when the bank notes pass through the Automatic Teller Machine (ATM), to obtain the original image data of the bank notes to be detected.

Figure 2:
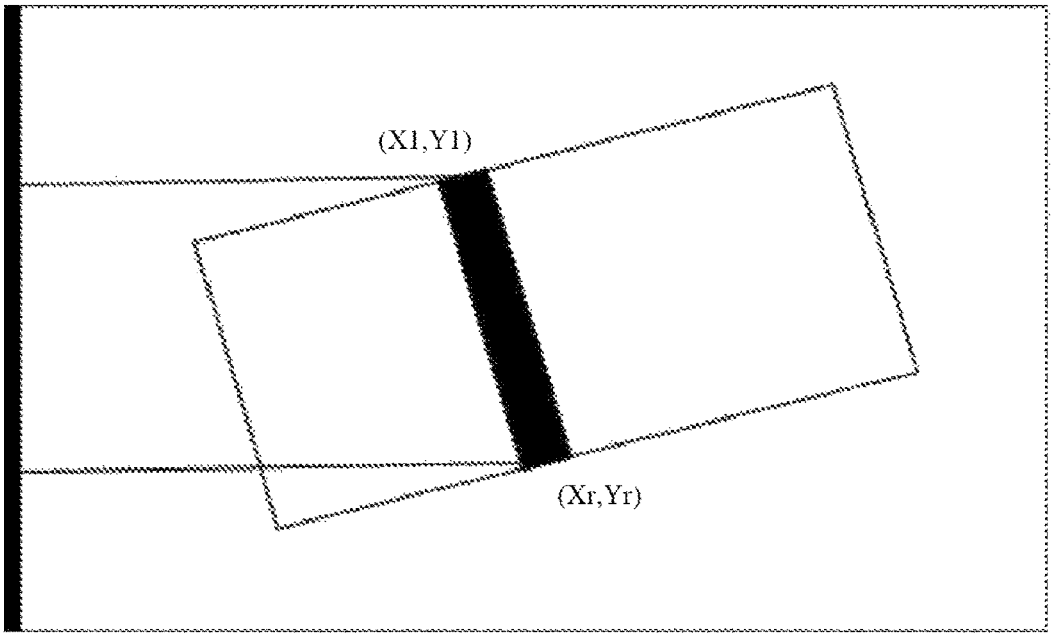
FIG. 2 is a schematic diagram of security thread positioning detection data of a single sheet of bank note in the method for detecting overlapped bank notes according to the embodiment of the present disclosure.

In step 20 of performing the security thread positioning detection, the security thread positioning detection is performed on the collected image data, to obtain security thread detection data. In most cases, the scanned image of the bank notes is tilted. Thus the security thread detection data, as shown in FIG. 2, includes a physical distance (X1, Y1) from an upper left vertex of a position of the security thread to a calibration side of a scanner and a physical distance (Xr, Yr) from an lower right vertex of the position of the security thread to the calibration side of the scanner, based on which an absolute position of the security thread to the calibration side is determined. Step 40 is performed after obtaining the security thread detection data.

In step 30 of performing the non-security thread positioning detection, the non-security thread positioning detection is performed on the collected image data, to obtain non-security thread detection data, and then step 50 is performed. In the embodiment, the non-security thread detection data includes the thickness of a non-security thread area.

Figure 3:
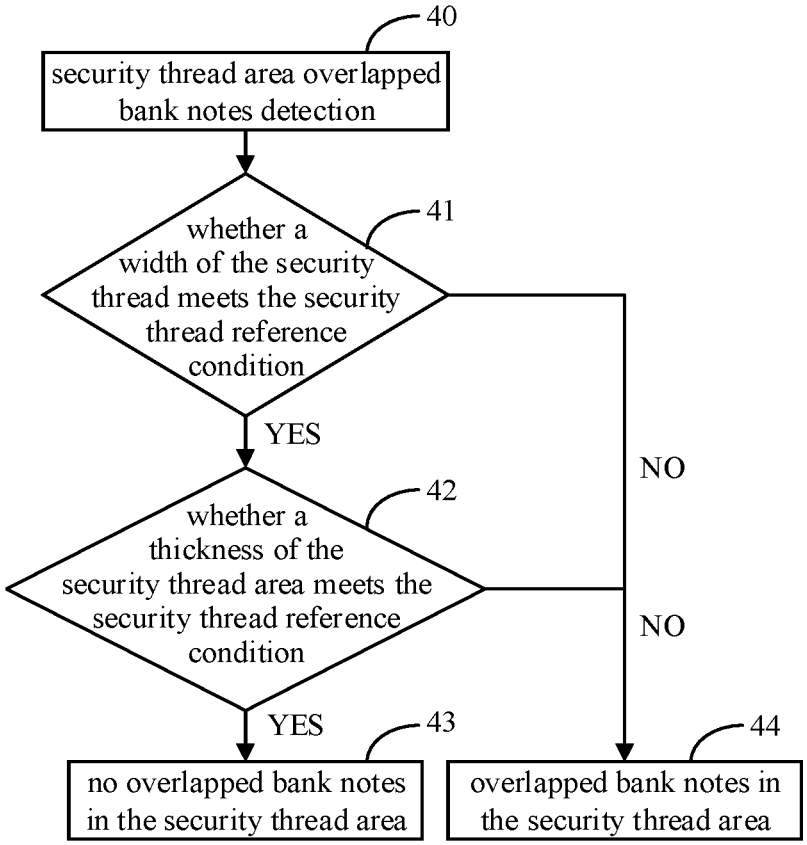
FIG. 3 is a flowchart of security thread area overlapped bank notes detection in the method for detecting overlapped bank notes according to the embodiment of the present disclosure.

In step 40 of detecting overlapped bank notes in the security thread area, as shown in FIG. 3, the determining whether the bank notes are overlapped in the security thread area is performed by first performing step 41 of determining whether the width of the security thread meets a security thread reference condition, going to step 42 if the width of the security thread meets the security thread reference condition, and going to step 44 if the width of the security thread does not meet the security thread reference condition. In step 42, it is determined whether the thickness of the security thread area meets the security thread reference condition. Step 43 of determining that the bank notes are not overlapped in the security thread area is performed if the thickness of the security thread area meets the security thread reference condition, and step 44 of determining that the bank notes are overlapped in the security thread area is performed if the thickness of the security thread area does not meet the security thread reference condition.

Figure 4:
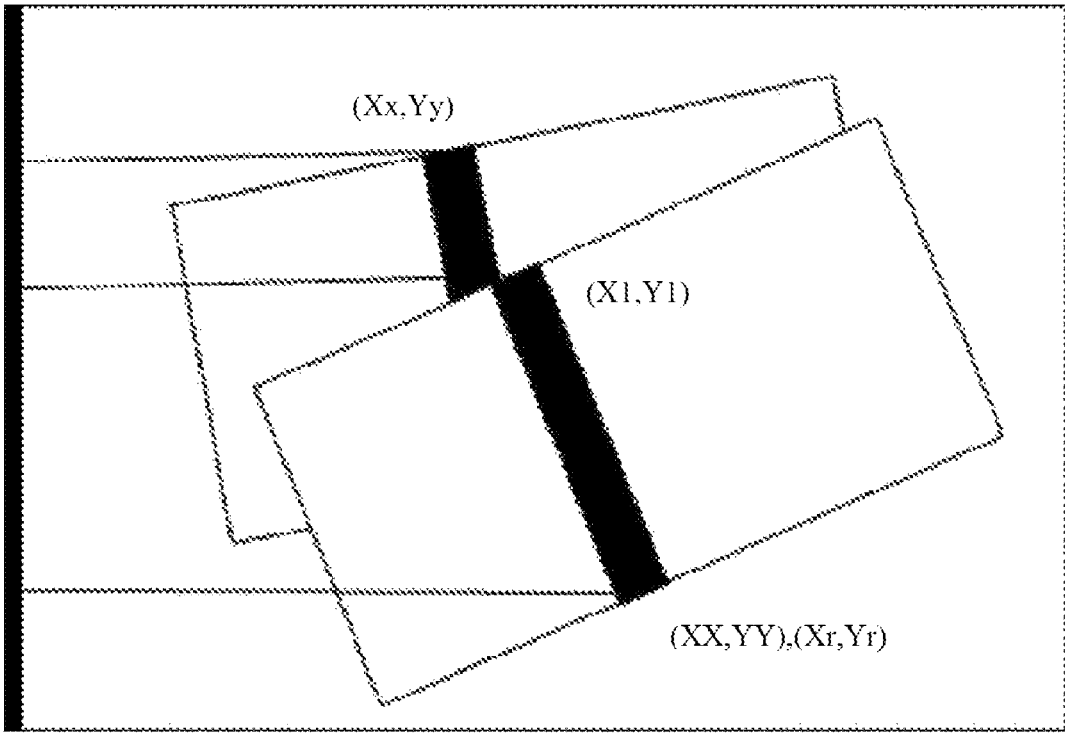
FIG. 4 is a schematic diagram showing that a width in the security thread area overlapped bank notes detection is abnormal in the method for detecting overlapped bank notes according to the embodiment of the present disclosure.

Step 41 of determining whether the width of the security thread meets the security thread reference condition may be performed as follows. As shown in FIG. 4, (X1, Y1) represents a position of an upper left vertex of a security thread of a single sheet of bank note to the calibration side, (Xr, Yr) represents a position of a lower right vertex of the security thread of a single sheet of bank note to the calibration side, (Xx, Yy) represents a position of an upper left vertex of a security thread of detected overlapped bank notes to the calibration side, (XX, YY) represents a position of a lower right vertex of the security thread of the detected overlapped bank notes to the calibration side, and T represents a preset non-negative threshold parameter. It is determined that the width of the security thread area does not meet the security thread reference condition and that the width of the security thread area is abnormal if the width of the security thread area meets $|(XX,YY)-(Xx,Yy)|>|(Xr,Yr)-(X1,Y1)|+T$, otherwise it is determined that the width of the security thread area meets the security thread reference condition and that the width of the security thread area is normal.

Step 42 of determining whether the thickness of the security thread area meets the security thread reference condition may be performed as follows. Supposing that a represents the thickness of the security thread area obtained by a current thickness sensor, b represents a reference value of the thickness of the security thread area, and t represents a preset non-negative threshold parameter, it is determined that the thickness of the security thread area does not meet the security thread reference condition and that the thickness of the security thread area is abnormal if the thickness of the security thread area meets a>b*t, otherwise it is determined that the thickness of the security thread area meets the security thread reference condition and that the thickness of the security thread area is normal.

It should be noted that the sequence between step 41 and step 42 is not fixed and is not limited here.

Figure 5:
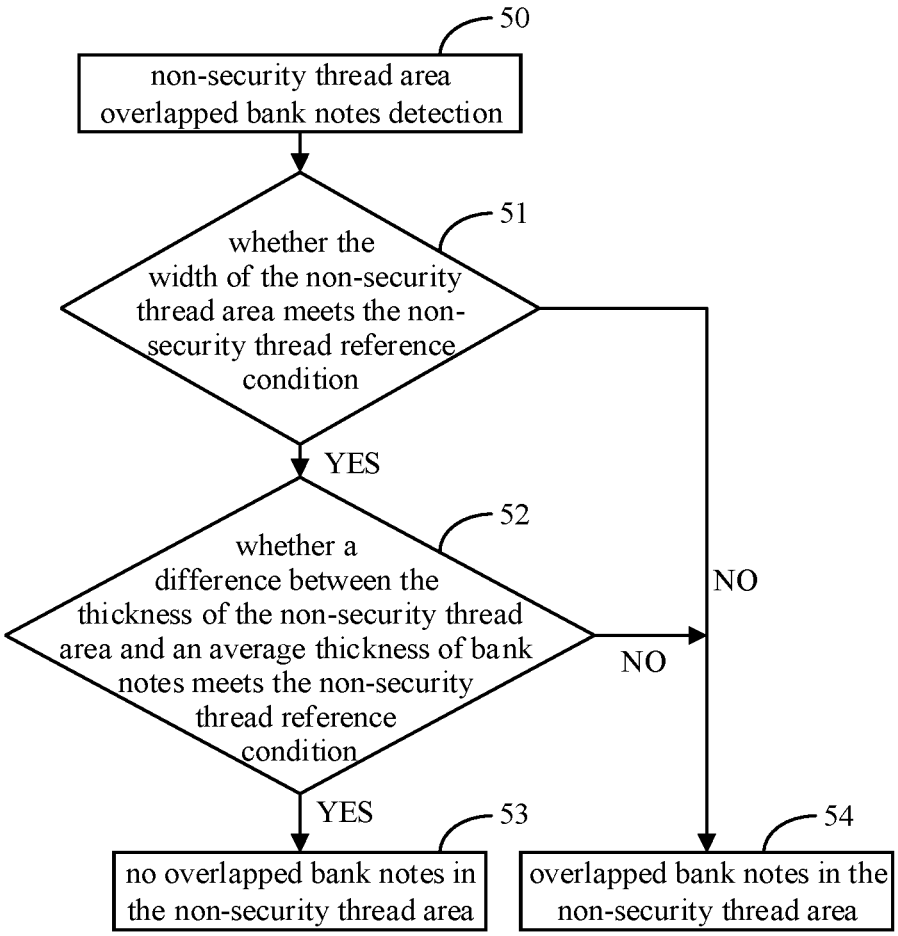
FIG. 5 is a flowchart of non-security thread area overlapped bank notes detection in the method for detecting overlapped bank notes according to the embodiment of the present disclosure.

In step 50 of detecting whether the bank notes are overlapped in the non-security thread area, as shown in FIG. 5, the detecting whether the bank notes are overlapped in the non-security thread area is performed by first performing step 51 of determining whether the thickness of the non-security thread area meets the non-security thread reference condition, going to step 52 if the thickness of the non-security thread area meets the non-security thread reference condition, and going to step 54 if the thickness of the non-security thread area does not meet the non-security thread reference condition. In step 52, it is determined whether a difference between the thickness of the non-security thread area and an average thickness of the bank notes meets the non-security thread reference condition. Step 53 of determining that the bank notes are not overlapped in the non-security thread area is performed if the difference between the thickness of the non-security thread area and an average thickness of the bank notes meets the non-security thread reference condition, and step 54 of determining that the bank notes are overlapped in the non-security thread area is performed if the difference between the thickness of the non-security thread area and an average thickness of the bank notes does not meet the non-security thread reference condition.

Step 51 of determining whether the thickness of the non-security thread area meets the non-security thread reference condition may be performed as follows. Supposing that c represents the thickness of the non-security thread area obtained by a current thickness sensor, d represents a reference value of the thickness of the non-security thread area, and s represents a preset non-negative threshold parameter, it is determined that the thickness of the non-security thread area does not meet the non-security thread reference condition and that the thickness of the non-security thread area is abnormal if the thickness of the non-security thread area meets c>d*s, otherwise it is determined that the thickness of the non-security thread area meets the non-security thread reference condition and that the thickness of the non-security thread area is normal.

Step 52 of determining whether the difference between the thickness of the non-security thread area and an average thickness of the bank notes meets the non-security thread reference condition may be performed as follows. Supposing that e represents the thickness of the non-security thread area obtained by a current thickness sensor, v represents an average thickness reference value of bank notes obtained through statistics, and f represents a preset non-negative threshold parameter, it is determined that the difference between the thickness of the non-security thread area and the average thickness of bank notes does not meet the non-security thread reference condition and the thickness of the non-security thread area is abnormal if the difference between the thickness of the non-security thread area and the average thickness of bank notes meets e-v>f, otherwise it is determined that the difference between the thickness of the non-security thread area and the average thickness of bank notes meets the non-security thread reference condition and the thickness of the non-security thread area is normal.

It should be noted that the sequence between step 51 and step 52 is not fixed and is not limited here. Also, in the present disclosure, the overlapped bank notes detection for the non-security thread area may be implemented by only performing step 51, or only performing step 52, or performing both step 51 and step 52 as in the above embodiment.

It should be noted that step 10 to step 70 are not performed sequentially, but performed in a logical sequence as shown in FIG. 1. For example, the sequences between step 20 followed by 40 and step 30 followed by 50 is not fixed and is not limited here.

In step 60, it is determined that the bank notes are not overlapped based on local overlapped bank notes determination results for the security thread area and the non-security thread area obtained in step 40 and step 50 and following a determination rule, and the process ends.

In step 70, it is determined that the bank notes are overlapped based on local overlapped bank notes determination results for the security thread area and the non-security thread area obtained in step 40 and step 50 and following a determination rule, and the process ends.

The determination rule includes: determining that the bank notes are overlapped if the bank notes are overlapped in the non-security thread area, and determining whether the bank notes are overlapped depending on the overlapped bank notes determination result for the security thread area if the bank notes are not overlapped in the non-security thread area. That is, it is determined that the bank notes are overlapped if the bank notes are overlapped in the security thread area, and it is determined that the bank notes are not overlapped if the bank notes are not overlapped in the security thread area. Alternatively, if the security thread area is judged first, it is determined that the bank notes are overlapped if the bank notes are overlapped in the security thread area, and whether the bank notes are overlapped is determined depending on the overlapped bank notes determination result for the non-security thread area if the bank notes are not overlapped in the security thread area. In summary, it is determined that the bank notes are overlapped if the bank notes are overlapped locally in the security thread area and/or the non-security thread area, and it is determined that the bank notes are not overlapped if the bank notes are not overlapped locally in any of the security thread area and the non-security thread area.

In the embodiment, the thickness of the security thread area and the thickness of the non-security thread area are distinguished and whether the bank notes are overlapped is determined by detecting and positioning the security thread of the bank notes, thereby avoiding the problem of misjudgment on overlapped bank notes due to an exceeding thickness of the security thread. Therefore, not only the overlapped bank notes can be detected accurately, but also the receiving rate of the bank notes can be improved greatly.

The method for detecting overlapped bank notes based on the multi-point thickness sensor according to the first embodiment of the present disclosure is introduced in detail above, and methods for detecting overlapped bank notes based on a single-point thickness sensor according to a second embodiment and a third embodiment of the present disclosure are described below.

Figure 7:
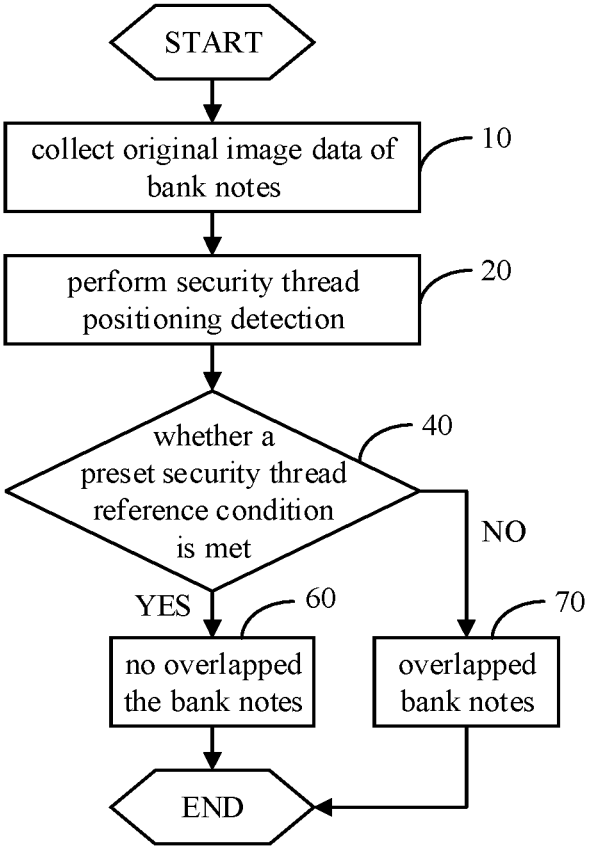
FIG. 7 is a flowchart of a method for detecting overlapped bank notes according to a second embodiment of the present disclosure.

As shown in FIG. 7, the method for detecting overlapped bank notes according to the second embodiment includes: step 10, collecting an original image data of the bank notes; step 20, performing security thread positioning detection on the original image data of the bank notes, to obtain security thread detection data; step 40, determining whether the security thread detection data meets a preset security thread reference condition, going to step 60 if the security thread detection data meets the preset security thread reference condition, and going to step 70 if the security thread detection data does not meet the preset security thread reference condition; step 60, obtaining a determination result that the bank notes are not overlapped, and ending the method; and step 70, obtaining a determining result that the bank notes are overlapped, and ending the method. The steps in this embodiment are the same as the corresponding steps having the same reference numbers in the first embodiment. That is, the second embodiment is a simplified version the first embodiment, in which whether the bank notes are overlapped is determined by determining whether the bank notes are overlapped in the security thread area, thereby avoiding the problem of misjudgment on overlapped bank notes due to an exceeding thickness of the security thread. Therefore, not only the overlapped bank notes can be detected accurately, but also the receiving rate of the bank notes can be improved greatly.

Figure 8:
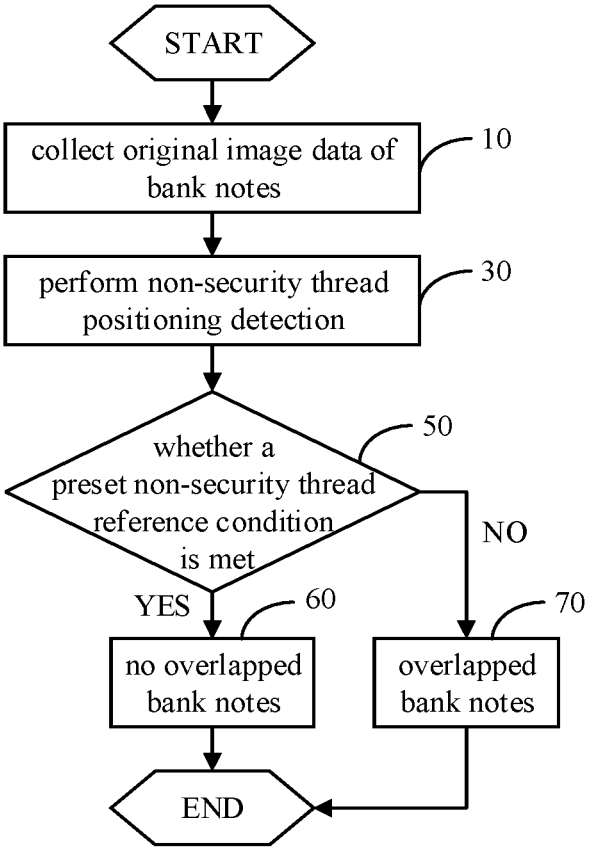
FIG. 8 is a flowchart of a method for detecting overlapped bank notes according to a third embodiment of the present disclosure.

Similarly, the first embodiment may also be simplified in another manner, in which, whether the bank notes are overlapped is determined by determining whether the bank notes are overlapped in the non-security thread area, as a third embodiment of the present disclosure. As shown in FIG. 8, the method for detecting the overlapped bank notes includes: step 10, collecting original image data of bank notes; step 30, performing non-security thread positioning detection on the original image data of the bank notes, to obtain non-security thread area detection data; step 50, determining whether the non-security thread area detection data meets a preset non-security thread reference condition, going to step 60 if the non-security thread area detection data meets the preset non-security thread reference condition, and going to step 70 if the non-security thread area detection data does not meet the preset non-security thread reference condition; step 60, obtaining a determination result that the bank notes are not overlapped, and ending the method; and step 70, obtaining a determining result that the bank notes are overlapped, and ending the method.

Figure 6:
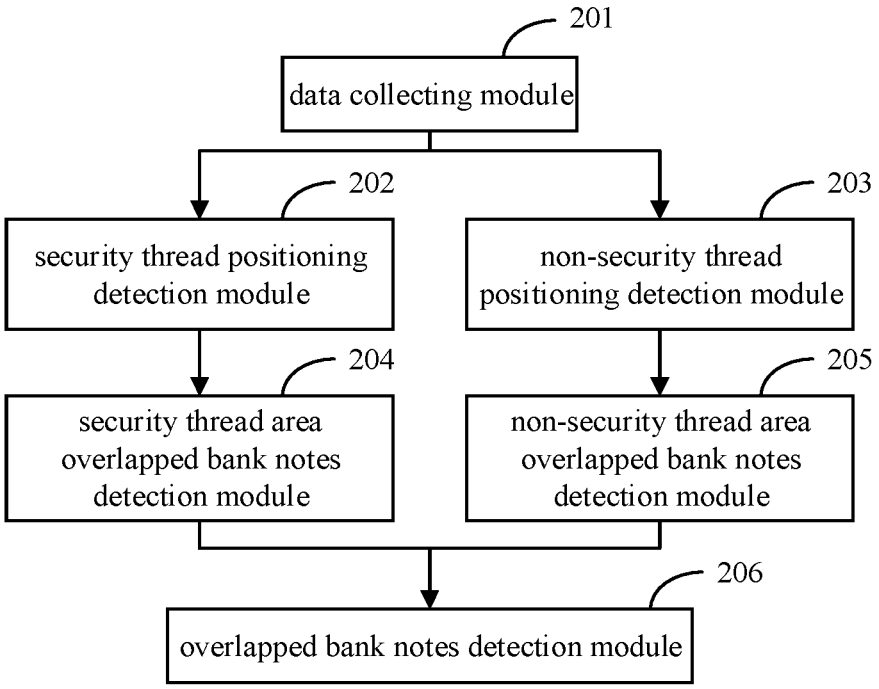
FIG. 6 is a schematic logical structural diagram of a first device for detecting overlapped bank notes according to an embodiment of the present disclosure.

The methods for detecting overlapped bank notes according to the present disclosure is described in detail above, and a device for detecting overlapped bank notes according to an embodiment of the present disclosure is described below. As shown in FIG. 6, the device for detecting overlapped bank notes includes: a data collecting module 201 configured to collect original image data of bank notes to be detected; a security thread positioning detection module 202 connected with the data collecting module and configured to perform security thread positioning detection on the collected original image data of the bank notes, to obtain security thread detection data; a non-security thread positioning detection module 203 connected with the data collecting module and configured to perform non-security thread positioning detection on the collected original image data of the bank notes, to obtain non-security thread detection data; a security thread area overlapped bank notes detection module 204 connected with the security thread positioning detection module and configured to determine whether a security thread area meets a security thread reference condition based on the security thread detection data, and determine that the bank notes are overlapped in the security thread area if the security thread detection data does not meet the security thread reference condition, and determine that the bank notes are not overlapped in the security thread area if the security thread detection data meets the security thread reference condition; a non-security thread area overlapped bank notes detection module 205 connected with the non-security thread positioning detection module and configured to determine whether a non-security thread area meets a non-security thread reference condition based on the non-security thread detection data, determine that the bank notes are overlapped in the non-security thread area if the non-security thread data does not meet the non-security thread reference condition, and determine that the bank notes are not overlapped in the non-security thread area if the non-security thread data meets non-security thread reference condition; and an overlapped bank notes detection module 206 connected with the security thread area overlapped bank notes detection module and the non-security thread area overlapped bank notes detection module and configured to detect whether the bank notes are overlapped based on local overlapped bank notes determination results for the security thread area and the non-security thread area and following a preset determination rule.

When bank notes pass through a signal scanning area of the ATM, the data collecting module 201 collects an original image data of the bank notes to be detected. After the original image data is obtained by the data collecting module 201, the security thread positioning detection module 202 performs security thread positioning detection on the original image data to obtain security thread detection data, and the non-security thread positioning detection module 203 performs non-security thread positioning detection on the original image data to obtain non-security thread detection data. Then the security thread area overlapped bank notes detection module 204 detects whether the bank notes are overlapped in the security thread area. The security thread area overlapped bank notes detection module 204 may detect whether the bank notes are overlapped in the security thread area includes as follows. (X1, Y1) represents a position of an upper left vertex of a security thread of a single sheet of bank note to the calibration side, (Xr, Yr) represents a position of a lower right vertex of a security thread of a single sheet of bank note to the calibration side, (Xx, Yy) represents a position of an upper left vertex of a security thread of detected overlapped bank notes to the calibration side, (XX, YY) represents a position of a lower right vertex of a security thread of detected overlapped bank notes to the calibration side, T represents a preset width non-negative threshold parameter, a represents the thickness of a security thread area obtained by a current thickness sensor, b represents a reference value of the thickness of the security thread area, and t represents a preset thickness non-negative threshold parameter. It is determined that the width of the security thread does not meet the security thread reference condition and that the bank notes are overlapped in the security thread area if the width of the security thread meets $|(XX,YY)-(Xx,Yy)|>|(Xr,Yr)-(X1,Y1)|+T$. A next step is performed if the width of the security thread meets the security thread reference condition. It is determined that the thickness of the security thread area does not meet the security thread reference condition and the bank notes are overlapped in the security thread area if the thickness of the security thread area meets a>b*t, otherwise it is determined that the bank notes are not overlapped in the security thread area.

The non-security thread area overlapped bank notes detection module 205 detects whether the bank notes are overlapped in the non-security thread area.

The non-security thread area overlapped bank notes detection module 205 may detect whether the bank notes are overlapped in the non-security thread area as follows. Supposing that c represents the thickness of the non-security thread area obtained currently by a thickness sensor, d represents a reference value of the thickness of the non-security thread area, s represents a preset non-negative threshold parameter 1, v represents an average thickness reference value of bank notes obtained through statistics and f represents a preset non-negative threshold parameter 2, it is determined that the thickness of the non-security thread area does not meet the non-security thread reference condition and that the bank notes are overlapped in the non-security thread area if the thickness of the non-security thread area meets c>d*s, otherwise a next step is performed. It is determined that the difference between the thickness of the non-security thread area and the average thickness of bank notes does not meet the non-security thread reference condition and that the bank notes are overlapped in the non-security thread area if the difference between the thickness of the non-security thread area and the average thickness of bank notes meets c-v>f, otherwise it is determined that the bank notes are not overlapped in the non-security thread area.

The overlapped bank notes detection module 206 determines whether the bank notes are overlapped based on local overlapped bank notes determination results obtained by the security thread area overlapped bank notes detection module 204 and the non-security thread area overlapped bank notes detection module 205 and following a determination rule. In the embodiment, the determination rule includes: determining that the bank notes are overlapped if the bank notes are overlapped in the non-security thread area, and determining whether the bank notes are overlapped depending on the overlapped bank notes determination result for the security thread area if the bank notes are overlapped in the non-security thread area. That is, it is determined that the bank notes are overlapped if the bank notes are overlapped in the security thread area, and it is determined that the bank notes are not overlapped if the bank notes are not overlapped in the security thread area. Alternatively, if the security thread area is judged first, it is determined that the bank notes are overlapped if the bank notes are overlapped in the security thread area, and whether the bank notes are overlapped is determined depending on the overlapped bank notes determination result for the non-security thread area if the bank notes are not overlapped in the security thread area. That is, it is determined that the bank notes are overlapped if the bank notes are overlapped in the non-security thread area, and it is determined that the bank notes are not overlapped if the bank notes are not overlapped in the non-security thread area.

Figure 9:
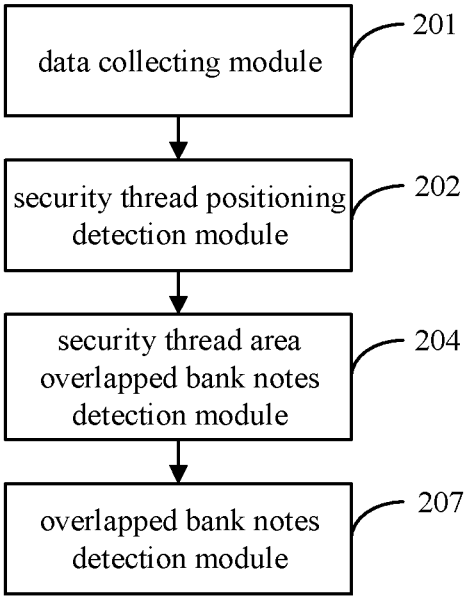
FIG. 9 is a schematic logical structural diagram of a second device for detecting overlapped bank notes according to an embodiment of the present disclosure.

The device for detecting overlapped bank notes according to the embodiment designed based on a multi-point thickness detection method is described above. Optionally, if a single-point thickness detection method is adopted, corresponding to the method for detecting overlapped bank notes according to the second embodiment, as shown in FIG. 9, a device for detecting overlapped bank notes according to this embodiment includes: a data collecting module 201 configured to collect original image data of bank notes to be detected; a security thread positioning detection module 202 connected with the data collecting module and configured to perform security thread positioning detection on the collected original image data of the bank notes, to obtain security thread detection data; a security thread area overlapped bank notes detection module 204 connected with the security thread positioning detection module and configured to determine whether a security thread area meets a security thread reference condition based on the security thread detection data, and determine that the bank notes are overlapped in the security thread area if the security thread detection data does not meet the security thread reference condition, and determine that the bank notes are not overlapped in the security thread area if the security thread detection data meets the security thread reference condition; and an overlapped bank notes detection module 207 connected with the security thread area overlapped bank notes detection module and configured to detect whether the bank notes are overlapped based on a local overlapped bank notes determination result for the security thread area and following a determination rule. The determination rule includes: determining that the bank notes are overlapped if the bank notes are overlapped in the security thread area; and determining that the bank notes are not overlapped if the bank notes are not overlapped in the security thread area.

Figure 10:
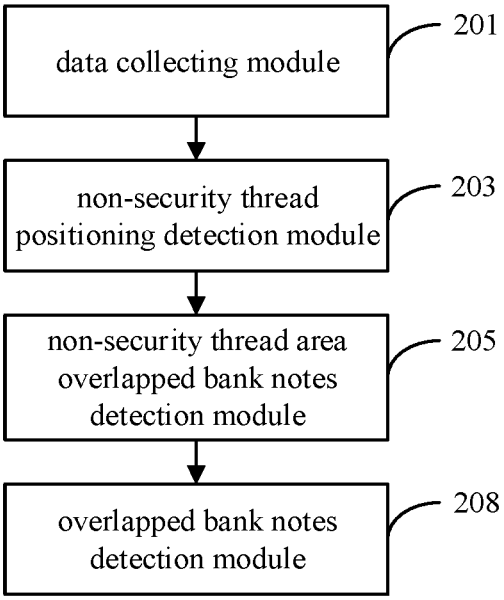
FIG. 10 is a schematic logical structural diagram of a third device for detecting overlapped bank notes according to an embodiment of the present disclosure.

Further optionally, corresponding to the method for detecting overlapped bank notes according to the third embodiment in which the single-point thickness detection is adopted, as shown in FIG. 10, a device for detecting overlapped bank notes according to this embodiment includes: a data collecting module 201 configured to collect original image data of bank notes to be detected; a non-security thread positioning detection module 203 connected with the data collecting module and configured to perform non-security thread positioning detection on the collected original image data of the bank notes, to obtain non-security thread detection data; a non-security thread area overlapped bank notes detection module 205 connected with the non-security thread positioning detection module and configured to determine whether a non-security thread area meets a non-security thread reference condition based on the non-security thread detection data, determine that the bank notes are overlapped in the non-security thread area if the non-security thread data does not meet the non-security thread reference condition, and determine that the bank notes are not overlapped in the non-security thread area if the non-security thread data meets non-security thread reference condition; and an overlapped bank notes detection module 208 connected with the non-security thread area overlapped bank notes detection module and configured to detect whether the bank notes are overlapped based on a local overlapped bank notes determination result for the non-security thread area and following a preset determination rule. The determination rule includes: determining that the bank notes are overlapped if the bank notes are overlapped in the non-security thread area; and determining that the bank notes are not overlapped if the bank notes are not overlapped in the non-security thread area.

Those skilled in the art should understand that all of or a part of steps of the above method embodiments may be performed by a program instructing corresponding hardware. The program may be stored in a computer readable storage medium. The storage medium may be a Read Only Memory, a magnetic disc or an optic disc.

The above described are only preferred embodiments of the present disclosure. It should be noted that the preferred embodiments described above should not regarded as limiting the present disclosure, and the scope of protection of the present disclosure is in accordance with the scope defined by the appended claims. Many improvements and modifications can also be made by those skilled in the art without departing from the spirit and scope of the present disclosure, and such improvements and modifications will also fall within the scope of protection of the present disclosure.

The invention claimed is:

1. A method for detecting overlapped bank notes, comprising:

step 10: collecting original image data of bank notes;

step 20: performing security thread positioning detection on the original image data of the bank notes, to obtain security thread detection data;

step 40: determining whether the security thread detection data meets a preset security thread reference condition, going to step 60 if the security thread detection data meets the preset security thread reference condition, and going to step 70 if the security thread detection data does not meet the preset security thread reference condition;

step 60: obtaining a determination result that the bank notes are not overlapped, and ending the method; and step 70: obtaining a determining result that the bank notes are overlapped, and ending the method;

wherein in the step 20, the security thread detection data comprises: a physical distance (X1, Y1) from an upper left vertex of a position of a security thread to a calibration side of a scanner, a physical distance (Xr, Yr) from a lower right vertex of the position of the security thread to the calibration side of the scanner, and an absolute position of the security thread to the calibration side determined based on the physical distance (X1, Y1) and the physical distance (Xr, Yr); and wherein the step 40 further comprises:

step 41: determining whether a width of the security thread meets the security thread reference condition, going to step 42 if the width of the security thread meets the security thread reference condition, and going to step 44 if the width of the security thread does not meet the security thread reference condition;

step 42: determining whether a thickness of a security thread area meets the security thread reference condition, going to step 43 if the thickness of the security thread area meets the security thread reference condition, and going to step 44 if the thickness of the security thread area does not meet the security thread reference condition;

step 43: determining that the bank notes are not overlapped in the security thread area, and going to step 50; and step 44: determining that the bank notes are overlapped in the security thread area, and going to step 70.

2. The method for detecting overlapped bank notes according to claim 1, wherein in the step 41 of determining whether the width of the security thread meets the security thread reference condition:

(X1, Y1) represents a position of an upper left vertex of a security thread of a single sheet of bank note to the calibration side, (Xr, Yr) represents a position of a lower right vertex of a security thread of a single sheet of bank note to the calibration side, (Xx, Yy) represents a position of an upper left vertex of a security thread of detected overlapped bank notes to the calibration side, (XX, YY) represents a position of a lower right vertex of a security thread of detected overlapped bank notes to the calibration side, and T represents a preset non-negative threshold parameter; and it is determined that the width of the security thread does not meet the security thread reference condition and that the width of the security thread is abnormal if the width of the security thread meets $|(XX,YY)-(Xx,Yy)|>|(Xr,Yr)-(X1,Y1)|+T$, and it is determined that the width of the security thread meets the security thread reference condition and that the width of the security thread is normal if the width of the security thread does not meet $|(XX,YY)-(Xx,Yy)|>|(Xr,Yr)-(X1,Y1)|+T$.

3. The method for detecting overlapped bank notes according to claim 1, wherein in the step 42 of determining whether the thickness of the security thread area meets the security thread reference condition:

a represents the thickness of the security thread obtained currently by a thickness sensor, b represents a reference value of the thickness of the security thread area, and t represents a preset non-negative threshold parameter; and it is determined that the thickness of the security thread area does not meet the security thread reference condition and that the thickness of the security thread area is abnormal if the thickness of the security thread area meets $a>b*t$, and it is determined that the thickness of the security thread area meets the security thread reference condition and that the thickness of the security thread area is normal if the thickness of the security thread area does not meet $a>b*t$.

4. A device for detecting overlapped bank notes, comprising:

a data collecting module configured to collect original image data of bank notes to be detected;

a security thread positioning detection module connected with the data collecting module and configured to perform security thread positioning detection on the collected original image data of the bank notes, to obtain security thread detection data;

a security thread area overlapped bank notes detection module connected with the security thread positioning detection module and configured to determine whether a security thread area meets a security thread reference condition based on the security thread detection data, and determine that the bank notes are overlapped in the security thread area if the security thread detection data does not meet the security thread reference condition, and determine that the bank notes are not overlapped in the security thread area if the security thread detection data meets the security thread reference condition; and an overlapped bank notes detection module connected with the security thread area overlapped bank notes detection module and configured to detect whether the bank notes are overlapped based on a local overlapped bank notes determination result for the security thread area and following a determination rule, wherein the determination rule comprises: determining that the bank notes are overlapped if the bank notes are overlapped in the security thread area; and determining that the bank notes are not overlapped if the bank notes are not overlapped in the security thread area;

wherein the security thread detection data comprises: a physical distance (X1, Y1) from an upper left vertex of a position of a security thread to a calibration side of a scanner, a physical distance (Xr, Yr) from a lower right vertex of the position of the security thread to the calibration side of the scanner, and an absolute position of the security thread to the calibration side determined based on the physical distance (X1, Y1) and the physical distance (Xr, Yr); and wherein the security thread area overlapped bank notes detection module is further configured to:

determine whether a width of the security thread meets the security thread reference condition;

determine whether a thickness of a security thread area meets the security thread reference condition.

* * * * *